United States Patent [19]

Walz

[11] Patent Number: 4,627,215

[45] Date of Patent: Dec. 9, 1986

[54] APPARATUS FOR CHARGING RECEPTACLES WITH STACKED, FLAT ITEMS

[75] Inventor: Theo Walz, Neunkirch, Switzerland

[73] Assignee: SIG Schweizerische Industrie-Gesellschaft, Neuhausen am Rheinfall, Switzerland

[21] Appl. No.: 732,274

[22] Filed: May 9, 1985

[30] Foreign Application Priority Data

May 9, 1984 [CH] Switzerland ..... 2272/84

[51] Int. Cl.[4] ..... B65B 5/06

[52] U.S. Cl. ..... 53/246; 53/251; 53/534; 198/346.2

[58] Field of Search ..... 53/246, 247, 249, 251, 53/252, 253, 260, 532, 534, 542; 198/424, 481

[56] References Cited

U.S. PATENT DOCUMENTS

| | | | |
|---|---|---|---|
| 2,855,740 | 10/1958 | Noland et al. | 53/534 X |
| 3,041,805 | 7/1962 | Fulco | 53/247 X |
| 3,290,859 | 2/1964 | Talbot | 53/534 |
| 3,340,676 | 9/1967 | Arnett | 53/247 |
| 3,479,795 | 11/1969 | Martin | 53/534 X |
| 3,641,737 | 2/1972 | Tamagni | 53/251 X |
| 3,789,575 | 2/1974 | Bross | 53/534 |
| 3,832,826 | 9/1974 | Ullman | 53/251 X |
| 4,035,986 | 7/1977 | Clem et al. | 53/247 X |

FOREIGN PATENT DOCUMENTS 532504 2/1973 Switzerland .

*Primary Examiner*—E. R. Kazenske
*Assistant Examiner*—Michael D. Folkerts
*Attorney, Agent, or Firm*—Spencer & Frank

[57] ABSTRACT

An apparatus for charging receptacles with groups of stacked articles includes a first conveyor for advancing article groups thereon towards a discharge end thereof; a second conveyor, situated below the first conveyor, for advancing receptacles to a filling position, a third conveyor for receiving the article groups from the discharge end of the first conveyor and advancing the article groups to a container dwelling in the filling position on the second conveyor and a pusher for sequentially pushing article groups from the discharge end of the first conveyor into the third conveyor. The third conveyor comprises a plurality of positioning devices, each having article group holding means, travelling sequentially and intermittently from the discharge end of the first conveyor downwardly to a location immediately above the filling position. The article groups are introduced from a respective positioning device into a respective container then situated in the filling position.

10 Claims, 4 Drawing Figures

FIG. 2
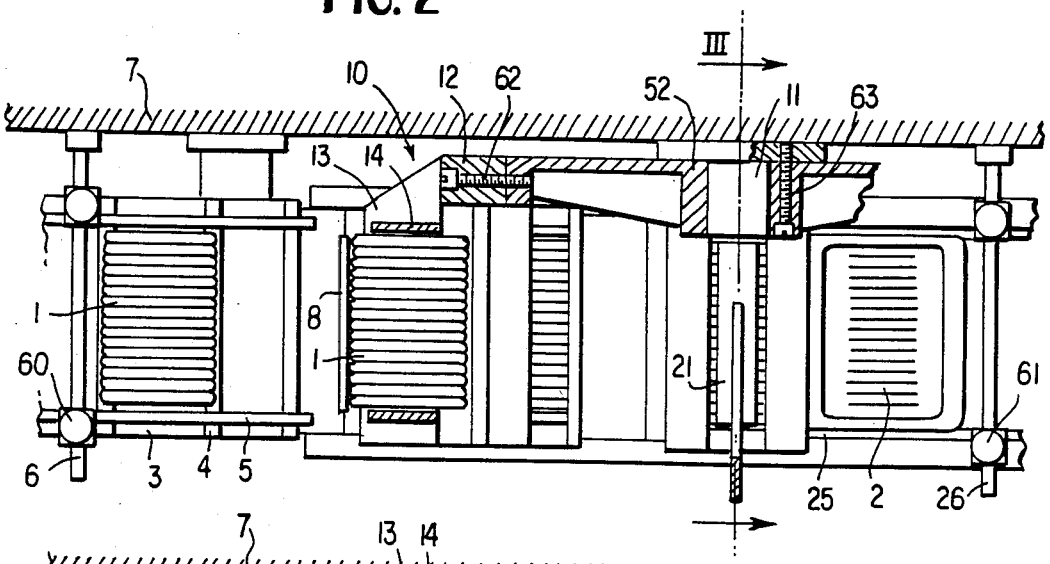
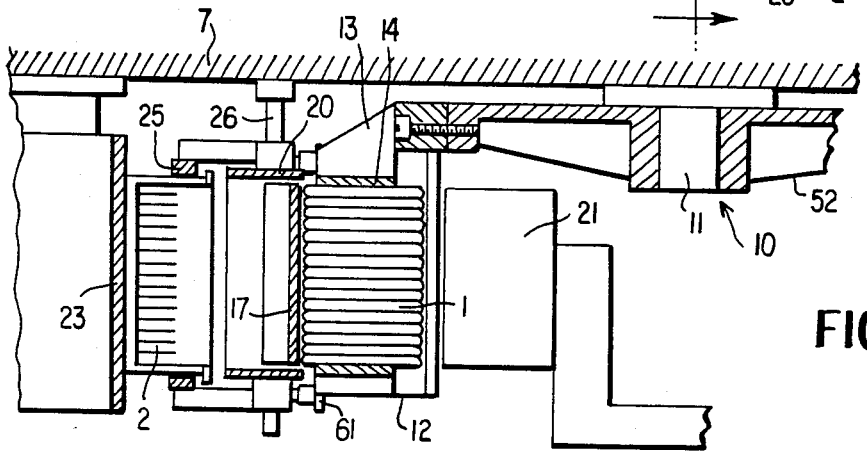
FIG. 3
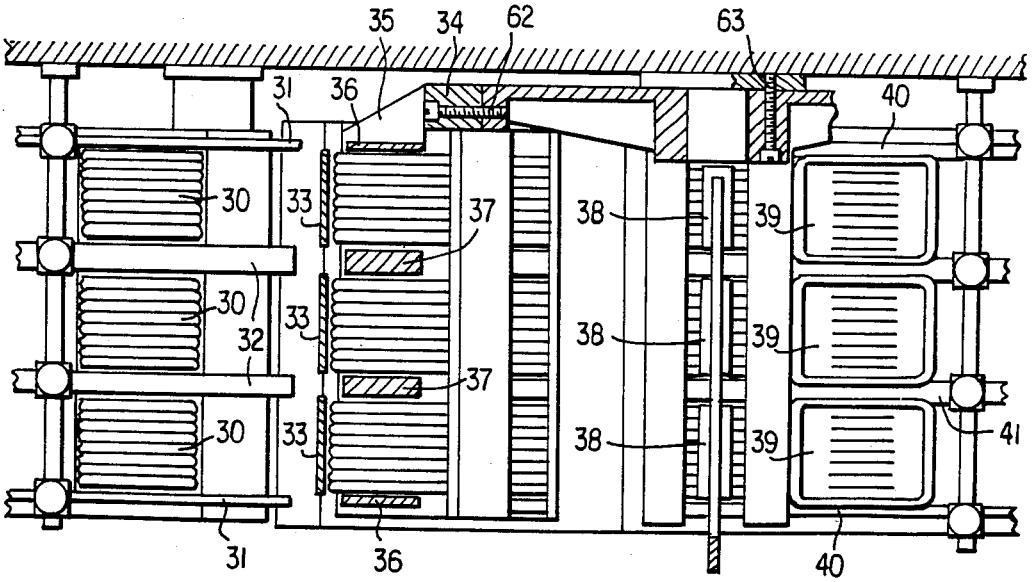
FIG. 4

APPARATUS FOR CHARGING RECEPTACLES WITH STACKED, FLAT ITEMS

BACKGROUND OF THE INVENTION

This invention relates to an apparatus for the automatic charging of containers (which are open at one side) with stacked, flat (disc or wafer-shaped) articles. The apparatus has a first conveyor for advancing the articles and a second conveyor for advancing the containers and further includes an intermediate conveyor device situated between the first and second conveyors. The intermediate conveyor device advances the stacked items to the lower-lying containers.

An apparatus of the above-outlined type is disclosed in Swiss Pat. No. 532,504. In this prior art construction the containers are tilted from a horizontal position into a vertical position in which the vertically oriented article stacks are pushed into the compartments of each container. The filled containers are subsequently tilted back into a horizontal orientation. This apparatus is also adapted to handle delicate articles such as cookies or biscuits but it has, however, the disadvantage that it is adapted to handle articles of only one shape and size and cannot be converted for use with different articles or to handle containers of different types.

Another apparatus of the above-outlined type is disclosed in U.S. Pat. No. 3,290,859. In this construction, in each charging cycle, two item rows are simultaneously placed into the container through a stationary funnel from which they fall directly into the container. Since the height from which the articles fall is relatively large, risks are high that delicate articles will be damaged. This apparatus is adapted only for disc-shaped items. In case of more significant differences in dimensions, the articles may jam which would result in an interruption of the packaging process.

SUMMARY OF THE INVENTION

It is an object of the invention to provide an improved apparatus of the above-outlined type from which the discussed disadvantages are eliminated and which is thus adapted to safely handle even delicate articles with a high output and which may be readily converted to accept differently shaped items and containers.

These objects and others to become apparent as the specification progresses, are accomplished by the invention, according to which, briefly stated, the intermediate conveyor device has an article supporting arrangement to which the article stacks are advanced by pushing means and further, the article supporting arrangement advances the article stacks stepwise to a lower-lying discharge location where the article stacks are placed into the packaging containers.

The apparatus according to the invention has a further advantage that it may be used with any type of charging device or apparatus for forming article groups.

BRIEF DESCRIPTION OF THE DRAWING

FIG. 2 is a sectional view taken along line II—II of FIG. 1.

FIG. 3 is a sectional view taken along line III—III of FIG. 2.

FIG. 4 is a sectional top plan view, similar to FIG. 2, of another preferred embodiment of the invention.

DESCRIPTION OF THE PREFERRED EMBODIMENTS

Figure 1:
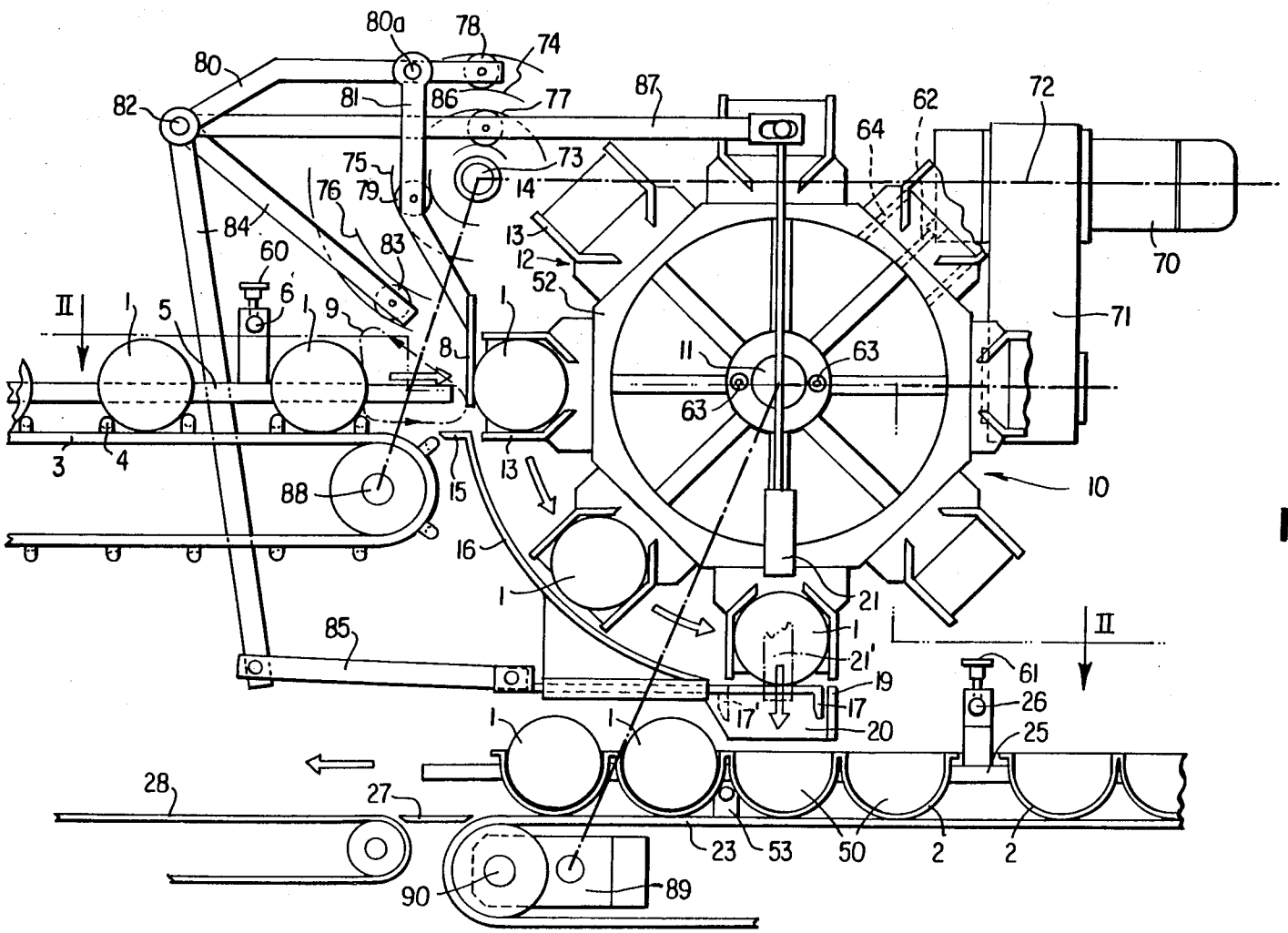
FIG. 1 is a schematic side elevational view of a preferred embodiment of the invention.

Turning now to FIG. 1, with the apparatus illustrated therein, items 1 such as cookies or biscuits are introduced in stacks into upwardly open containers 2 which are preferably of plastic. Each container 2 has four side-by-side arranged pockets or compartments 50 into which the stacks of items 1 are deposited. The number of the pockets 50 in each container 2 may vary and also, the shape of the pockets 50 themselves may vary to receive, for example, angular items.

The stacked, edgewise upright oriented items 1 are advanced on an endless first conveyor belt 3, equipped with article pushers 4, to an exchangeable intermediate conveyor device 10. The item stacks are oriented transversely to the advancing direction and are guided on the conveyor 3 by lateral guide rails 5 which are secured to transverse holder bars 6 and which may be slidably adjusted and immobilized thereon by means of screw-down handles 60. At the frontal (discharge) end of the first conveyor belt 3 there is arranged an inserting pusher 8 which executes its motion along a path 9 synchronously with the conveying movement of the articles 1 and in each instance pushes one stack of articles onto a transfer plate 15 and then into an aligned positioning device 12. The intermediate conveyor 10, on whose circumference eight positioning devices 12 are mounted, rotates stepwise about a drive shaft 11 and advances the article stacks downwardly in a counterclockwise direction as viewed in FIG. 1. In order to prevent the articles from falling out of the positioning devices 12 the latter have brackets 13 oriented perpendicularly to the conveying direction and lateral guide walls 14 arranged therebetween and extending parallel to the conveying direction. An arcuate, circumferential retainer plate 16 extending concentrically with the shaft 11 and being radially outwardly spaced from the positioning devices 12 retains the articles within the positioning devices 12.

The positioning devices 12 are readily removably mounted on the wheel-like body 52 of the intermediate transporting device 10 and may be replaced if, for example, larger items, longer stacks or a greater number of serially arranged article stacks have to be filled into the containers. For this purpose, the brackets 13 and guide walls 14 are provided with two positioning pins 64 and are secured to the wheel-like body 52 by means of a screw 62. For removing any positioning device 12 thus merely the screw 62 has to be loosened. The entire intermediate conveyor 10 may be replaceable by loosening two screws 63 which affixes the conveyor 10 to the shaft 11.

Upon reaching the deepest location of the circular path of movement, the intermediate transport device 10 is stopped for a short time whereupon the stacks of articles 1 may fall by gravity into an aligned compartment 50 of a container 2 as soon as a bottom gate 17 is moved by a non-illustrated device, into the phantom line position 17'. The back-and-forth movement of the gate 17 is effected synchronously with the stepped advance of the articles. The articles 1 are guided by guide plates 19 and 20 during their fall into the containers 2.

In order to ensure that even jammed articles 1 may fall out of th positioning devices 12, there is provided an ejector 21 which is secured to an only symbolically shown linkage 92 (FIG. 3) and which moves downwardly into the phantom line position 21' with approximately the same speed as the falling items 1. Any item 1 or item stack which is jammed is pushed out of the positioning device 12 by the ejector 21.

The empty containers 2 are advanced to the intermediate transport device 10 on a second, intermittently driven conveyor belt 23 having pusher bars 53 which entrain each container 2 by projecting between two consecutive pockets 50 thereof. The containers 2 are guided by guide rails 25 which are secured to transverse holder bars 26 and which may be slidably adjusted and immobilized thereon by means of screw-down handles 61 (FIG. 3). The filled containers 2 are pushed from the conveyor belt 23 over a transfer plate 27 to a further conveyor belt 28 which carries the loaded containers to the subsequent processing station, such as a packing machine.

In the description which follows, the coordinated drive of the conveyor system will be set forth, with further reference to FIG. 1.

A drive motor 70 operates a stepping drive 71 of conventional construction such as a Geneva gear mechanism. The motor 70 also drives a shaft 73 with the intermediary of a shaft 72. On the shaft 73 there are coaxially mounted four cam discs 74, 75, 76 and 77. The cam discs 74 and 75 drive two levers 80 and 81 with the intermediary of follower rollers 78 and 79. The lever 80 is pivotally supported on a stationary pivot 82 whereas the lever 81 is pivotally mounted on the lever 80 at 80*a*. The cam disc 76 moves the gate 17 in and out with the intermediary of a follower roller 83, an angled lever 84 as well as a coupling rod 85. The cam disc 77 moves the ejector 21 up and down with the intermediary of a follower roller 86 and a lever 87. The shaft 73 rotates a drive shaft 88 of the first conveyor belt 3. The stepping gear mechanism 71 rotates the shaft 11 stepwise and thus intermittently turns the intermediate transport device 10. The shaft 11 is operatively connected with a drive 89 which moves stepwise an output shaft 90 of the conveyor 12. The transmission ratio of the drive 89 is so selected that the conveyor belt 23 moves in each step a distance which corresponds to the spacing between two adjoining compartments 50.

The apparatus illustrated in FIGS. 1, 2 and 3 with which in each cycle an article stack is deposited in the containers 2 may be converted in a simple manner—by replacing the positioning devices 12 or the entire intermediate transport device 10—to a charging device with which in each operational cycle a plurality of side-by-side arranged article stacks may be handled.

Thus, with reference to FIG. 4, with the embodiment shown therein three article stacks 30 may be simultaneously filled into three containers 39 guided between guide rails 40 and 41. The positioning devices 34 have, between brackets 35, lateral outer guide walls 36 and transversely spaced inner guide walls 37, one situtated between any two side-by-side adjoining article stacks 30, thus dividing each positioning device 34 into compartments whose number equals the number of tracks on the conveyor 3, defined by the guide rails 31, 32. Accordingly, on the first conveyor device 3 there are provided two inner guide rails 32 and two lateral guide rails 31 as well as three-part inserting pusher 33. An ejector 38 is so dimensioned that all three article stacks 30 may be simultaneously pushed out. Instead of a plurality of equally long article stacks 30 it is feasible to provide article stacks of different lengths.

It will be understood that the above description of the present invention is susceptible to various modifications, changes and adaptations, and the same are intended to be comprehended within the meaning and range of equivalents of the appended claims.

What is claimed is:

1. In an apparatus for charging receptacles with groups of stacked, flat, wafer-shaped articles, including a first conveyor means for advancing article groups thereon towards a discharge end thereof; a second conveyor means, situated below said first conveyor means, for advancing receptacles to a filling position and third conveyor means for receiving the article groups from the discharge end of the first conveyor means and advancing the article groups to a container dwelling in said filling position on said second conveyor means, the improvement comprising pusher means for sequentially pushing article groups from the discharge end of said first conveyor means into said third conveyor means and wherein said third conveyor means comprises a plurality of positioning devices, each having article group holding means, travelling sequentially and intermittently from adjacent said discharge end of said first conveyor means downwardly to a location immediately above said filling position, and means for introducing the article groups from a respective said positioning device in said location thereof into a respective said container in said filling position thereof; said means for introducing the article groups including a bottom gate situated in said filling position and having a first position in which it is situated such as to prevent article groups from passing from said location into said container in said filling position thereof and a second position in which it is situated such as to allow article groups to pass from said location into said container in said filling position; guide plate means situated in said location between the positioning device dwelling in said location and said container dwelling in said filling position for guiding each article group in said location from the positioning device into the container; and ejector means positioned in alignment with said location and said filling position for pushing the article group from the positioning device dwelling in said location toward said container dwelling in said filling position.

2. An apparatus as defined in claim 1, wherein said positioning devices have a direction of travel; each said positioning device comprising two brackets spaced from one another in said direction of travel and extending perpendicularly thereto and side walls connecting said brackets with one another and extending parallel to said direction of travel.

3. An apparatus as defined in claim 2, wherein said first and said second conveyor means each comprise a plurality of adjustable lateral guides for defining a plurality of side-by-side arranged conveyor tracks for the article groups and the container, respectively, further wherein each said positioning device comprises a plurality of spaced lateral guide walls dividing each positioning device into compartments corresponding in number to that of said conveyor tracks.

4. An apparatus as defined in claim 1, wherein said third conveyor means comprises a wheel supported by a shaft; said positioning devices are mounted on said wheel in a circumferentially spaced distribution.

5. An apparatus as defined in claim 1, wherein said second conveyor means is driven intermittently.

6. An apparatus as defined in claim 1, wherein said first and said second conveyor means comprise adjustable lateral guides for the article groups and the containers, respectively.

7. An apparatus as defined in claim 1, wherein said first and said second conveyor means each comprise a plurality of adjustable lateral guides for defining a plurality of side-by-side arranged conveyor tracks for the article groups and the containers, respectively.

8. An apparatus as defined in claim 1, further wherein said means for introducing the article groups includes means for driving said bottom gate and said ejector means in synchronism with one another.

9. An apparatus as defined in claim 1, further comprising means for readily removably securing said positioning devices.

10. An apparatus as defined in claim 1, further comprising means for readily removably securing said third conveyor means.

* * * * *